US009073377B2

(12) United States Patent
Freidl

(10) Patent No.: US 9,073,377 B2
(45) Date of Patent: Jul. 7, 2015

(54) POCKET-SIZED DISPOSABLE PHOTO ALBUM KIT

(76) Inventor: Michael Freidl, Aliso Viejo, CA (US)

( * ) Notice: Subject to any disclaimer, the term of this patent is extended or adjusted under 35 U.S.C. 154(b) by 1721 days.

(21) Appl. No.: 12/247,307

(22) Filed: Oct. 8, 2008

(65) Prior Publication Data

US 2010/0084847 A1 Apr. 8, 2010

Related U.S. Application Data

(60) Provisional application No. 60/998,576, filed on Oct. 12, 2007.

(51) Int. Cl.

| | |
|---|---|
| ***B42D 1/00*** | (2006.01) |
| ***B42D 19/00*** | (2006.01) |
| ***B42D 15/00*** | (2006.01) |
| ***B42D 1/08*** | (2006.01) |

(52) U.S. Cl.

CPC ..... *B42D 1/08* (2013.01)

(58) Field of Classification Search

CPC ..... B42D 1/00; B42D 19/00; B42D 11/00; B42D 15/00

USPC ..... 281/2, 5, 12, 51; 283/62, 63.1, 67, 77, 283/101, 105, 117; 402/80 R

See application file for complete search history.

(56) References Cited

U.S. PATENT DOCUMENTS 4,911,478 A * 3/1990 Oshikoshi et al. ..... 283/77
6,135,504 A * 10/2000 Teng ..... 283/67

* cited by examiner

*Primary Examiner* — Shelley Self
*Assistant Examiner* — Justin V Lewis
(74) *Attorney, Agent, or Firm* — Fish & Tsang, LLP

(57) ABSTRACT

A kit is provided that assists a customer to produce a pocket-sized, disposable photo album. The kit generally has some paper that has been perforated and scored into a grid of wallet-sized rectangles, some adhesives, and instructions for use. A customer prints wallet-sized photos onto the paper within the wallet-sized rectangles. The customer then tears along the perforation lines to create strips of rectangles, and tapes the strips together end-to-end. Lastly, the customer folds the rectangles along the score lines in an accordion-like fashion to create an expandable album that is easily shared. The resulting "album" can be carried in most any pocket and displayed at a moment's notice. This type of album is particularly useful to people who carry wallets instead of purses, but would otherwise like to share photos.

7 Claims, 5 Drawing Sheets

POCKET-SIZED DISPOSABLE PHOTO ALBUM KIT

This application claims the benefit of priority to U.S. provisional application having Ser. No. 60/998,576 filed on Oct. 12, 2007. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

BACKGROUND

The advent of digital photography and Internet-based photo sharing sites has made photography more popular and accessible to the masses. However, photo sharing sites do not facilitate displaying of images when users are off-line and away from a computer. While inkjet printers have become more very adept at printing images, users who are inclined to print images on photo paper still need a traditional photo album in order to keep images together and facilitate their display.

Printing photographs onto sheets of paper allows a person to view photographs when the person is off-line and away from a computer. However, carrying around sheets of printed photographs is cumbersome and difficult. Some computer software comes with pre-made templates that make selecting images to print in various sizes fast and easy. For example the Windows™ XP operating system has a photo printing wizard that prints sheets of so-called "wallet sized photos." Each such sheet contains up to nine images arranged in a three-by-three grid. Each image is 2½"×3¼"

These "wallet-sized photos" can be displayed in the sheet format or the images can be separated by cutting them apart. However, there are various problems inherent with doing so. For example, cutting the images into identical wallet-sized prints can be tedious and requires the user to put each individual photo into a separate pocket of the wallet. Alternatively, if a user instead folds an 8½"×11" sheet of images over and over again until it is wallet-sized, the paper would bulge and "scrunch" where the thickest folds are located, which would reduce the quality of the images. Such a sheet would also be time-consuming to retrieve and fold and unfold every time a person wishes to display the photographs.

Thus, there is still a need in the art for systems and methods of easily creating portable photographs that are easily transported and displayed.

SUMMARY OF THE INVENTION

The present invention provides apparatus, systems, and methods in which a customer can produce a pocket-sized, disposable photo album. The customer is generally provided with a kit that includes sheets of printer paper, adhesives, and instructions for creating the photo album.

The printer paper is generally a standard size and is of sufficient density and quality to facilitate printing of images, so that a customer can use the kit right out of the box without any customization. Preferably, the printer paper is dense enough to absorb inkjet ink, which is a common standard for contemporary printers. In order to divide the paper into wallet-sized rectangles, the printer paper is perforated along one axis, and is scored along another axis to create strips of wallet-sized rectangles. For example, if using a printer paper that is the standard letter size of 8½"×11", the paper could be perforated and scored into a 3×3 grid such that, when torn along the perforations, the sheet of paper is separated into three strips, each containing three rectangles that have scored borders. Preferably, the border of the grid itself could also be perforated since such a grid is typically smaller than a standard 8½"×11" paper. Thus, by printing photographs into each rectangle, and tearing along the perforations, a customer could create strips of photographs that can be easily folded along score lines.

The strips of photographs could then be attached to one another end-to-end using an adhesive to make a long strip of photographs that are easily folded accordion style to create a "brag strip." The strips of photographs fit easily within a standard wallet or a pocket when folded, but are easily unfolded to be displayed to friends and colleagues. As used herein, a pocket is any pocket in a garment or accessory that is worn by a human being. Thus, while the folded brag strip is typically 2½" by 3¼" to fit in a standard wallet, the size and shape of the rectangles could be altered in any suitable way to fit pockets or wallets of other shapes and sizes. Since brag strips are typically assembled by bonding strips of photographs end-to-end, the final brag strip could be as short or as long as the customer wishes.

The adhesive that is used to bond the strips of photographs together could be any compound that adheres or bonds two items together, either natural or synthetic. Preferably, the adhesive is located on a strip of clear tape with a guide-line to assist a user in placing the adhesive in an optimal location. The tape could be provided on a standard roll that could be torn off, but is preferably pre-cut into standardized pieces and presented to the customer on a separate sheet of paper or on the ends of the 3×1 photograph strips so as to save time and energy during assembly. In a preferred embodiment, the custom tape strips are cut to be exactly 3⅛"×⅜" and are presented on a 8½"×11" paper that has 60 tape strips to a sheet. The provider of the kit could also put its logo or company name on the tape to assist in advertising the product to anyone who is shown the "brag strip" by a customer.

Preferably, the kit comes with instructions to inform the customer how to print photos on the printer paper, separate the printer paper along the perforated lines to form strips of photographs, fold the printer paper along scored lines, and bond strips of photographs end-to-end to form long brag strips that fit in a standard pocket. The instructions could be verbal, textual, diagrammatic, photographic, or any combination thereof. In one embodiment, the instructions are provided in a computer software program that could be installed on a customer's computer.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
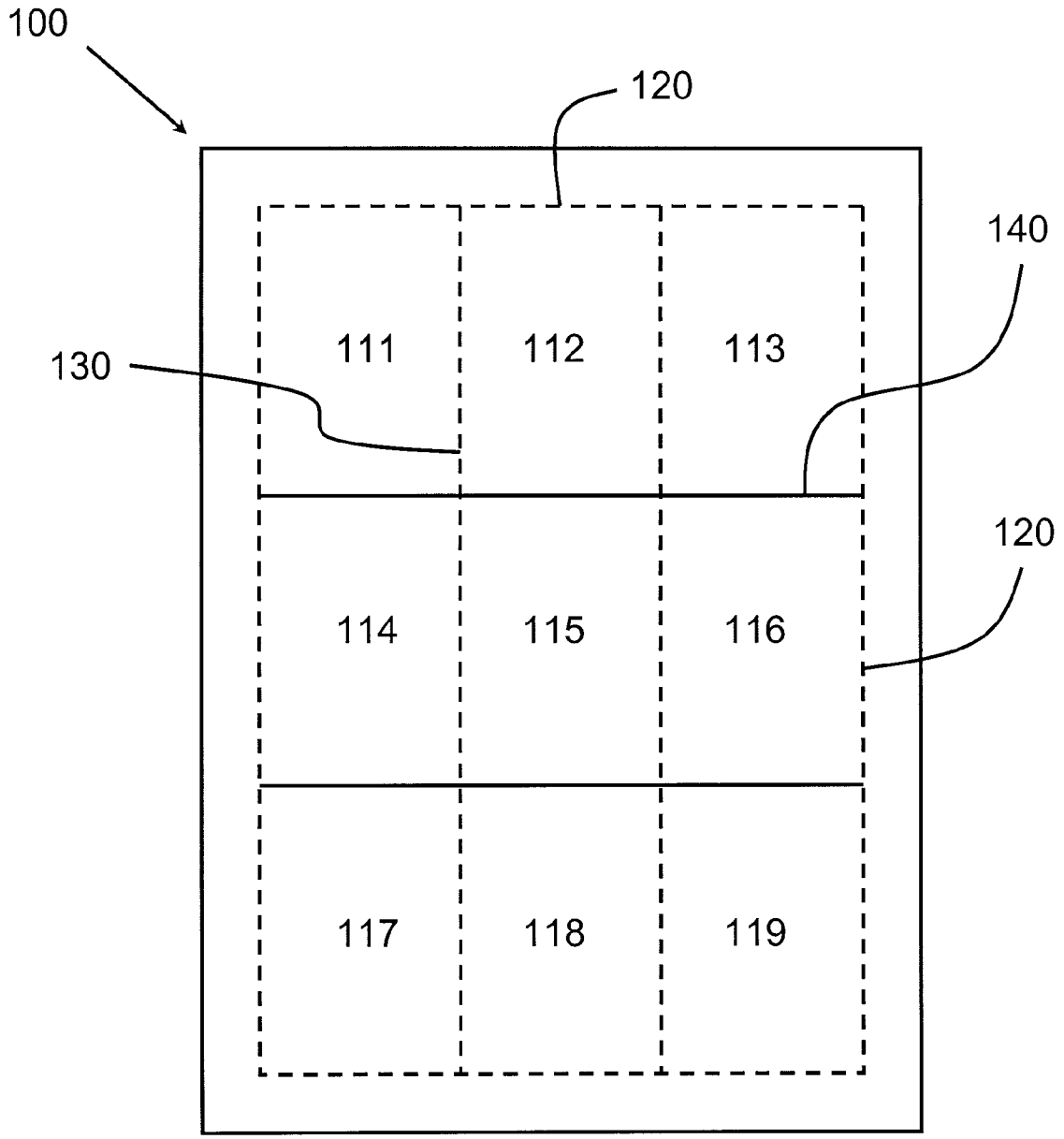
FIG. 1 is a front perspective view of a sheet of printer paper that is perforated and scored in accordance with one embodiment of the present invention.

In FIG. 1, a sheet of printer paper 100 is generally divided into rectangular areas 111-119 using perforated and scored borders. It should be appreciated that while rectangular areas 111-119 are divided into nine identical rectangles approximately 2½"×3¼", the rectangles do not need to have those dimensions, and do not even have to be identical. Rectangles located on different "strips" could be of different sizes to accommodate different size photographs, wallet sizes, and/or pocket sizes. Additionally, the grid does not need to be constricted to a 3×3 size, and could be 1×3, 5×4, or even 3×9, depending on the size of the printer paper and the desired size of the photographs. Preferably the grid is larger than 2×2. All distances referred to herein are approximate within a tolerance of ⅛ inch.

Since the grid is slightly smaller than the page, the border of the grid 120 is perforated so the grid itself can be easily removed after printing. The grid is also preferably located in the center of the page for easy printing, since many printers are unable to print to the edges of a sheet of printer paper. While the grid is preferably centered, it is contemplated that the grid could be placed on an edge of the paper, so that the perforated border only has three sides, or could be placed in the corner of the paper, so that the perforated border only has two sides.

The rectangular areas themselves are generally divided from one another by perforated borders 130 and scored borders 140. For example, perforated border 130 divides rectangular area 112 from rectangular area 111, and scored border 140 divides rectangular area 112 from rectangular area 115. The scored and perforated borders preferably run along the entire length of the grid, and are substantially perpendicular from one another. As used herein, "substantially perpendicular" means that the lines are ninety degrees from one another plus or minus five degrees. Additionally, while the perforated lines are shown to be straight lines, the perforated lines could be curved, rounded, or jagged without departing from the scope of the present invention.

As used herein, a border is "perforated" when a series of holes are punctured along the border. Preferably, the series of holes are elongated and are spaced close enough together so that the printer paper could be torn more easily along the border. While the border is shown as perforated, it is contemplated that instead of perforating the border, the border could merely be marked with a dotted line that shows a customer where to cut. It should be noted, however, that marking a border and perforating a border are two different acts. As used herein, a border is "scored" when the border is weakened by scratching a line along the border. Preferably, the paper is scored on both sides of the paper to easily allow the paper to fold in either direction.

Figure 2:
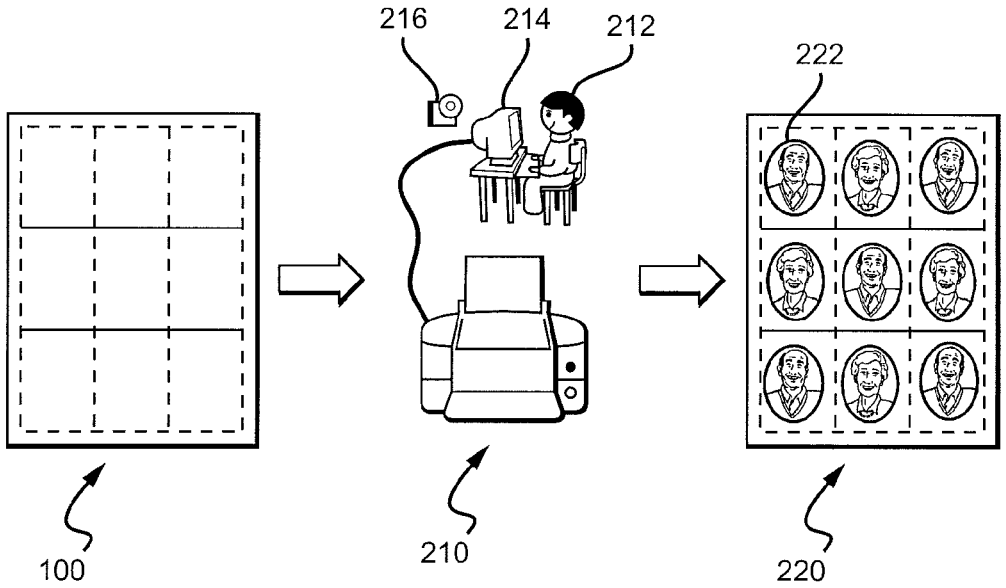
FIG. 2 is a diagrammatic flow-chart illustrating how a printer prints photographs on the printer paper of FIG. 1.

In FIG. 2, the printer paper 100 is run through printer 210 so that photographs 222 are printed on inked printer paper 220. In a preferred embodiment, printer 210 is connected to a Windows™ XP computer system 214 that enables a customer 212 to print photos 222 on inked printer paper 220. A Windows™ computer system is preferred, since most systems come preinstalled with a "Photo Printing Wizard" that easily allows a user to print a series of Wallet-sized prints in the center of a sheet of printer paper, where each print is approximately 2½"×3¼" in dimension. If a customer does not have a Windows™ system with the "Photo Printing Wizard" installed, the customer could always be provided with software 216 that could be installed on the system to provide such printing templates. While software 216 is shown as a CD, software 216 could be provided in any suitable manner, for example a USB drive or via an internet download. It is also contemplated that a customer could print photographs on both sides of printer paper 100 to create a double-sided brag strip.

Figure 3:
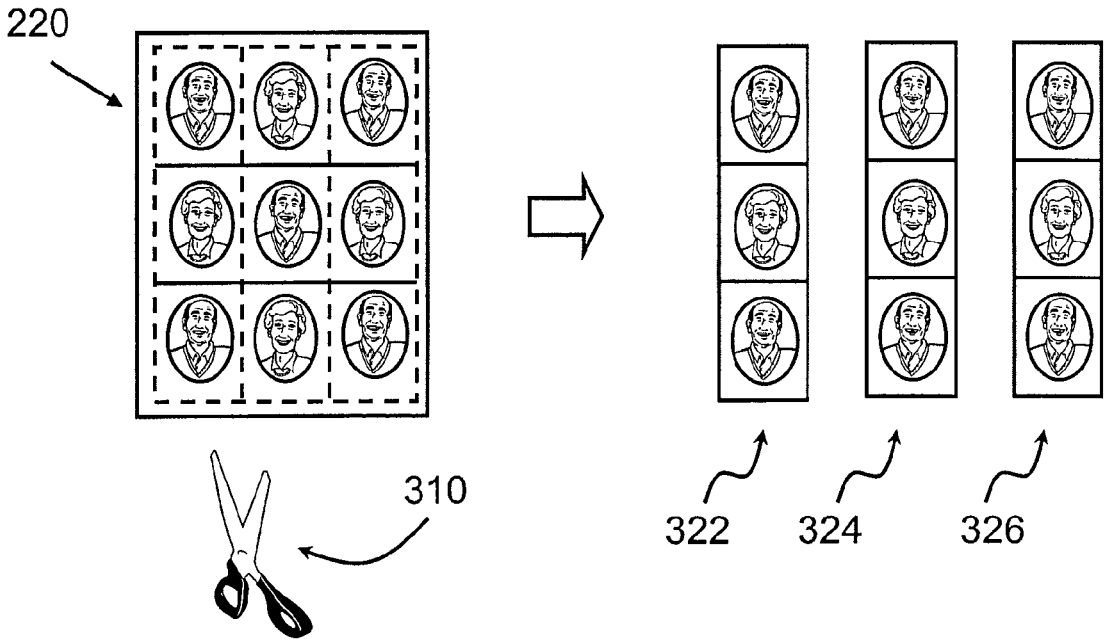
FIG. 3 is a diagrammatic flow-chart illustrating how the printer paper of FIG. 2 is split into sheets of photographs.

In FIG. 3, the inked printer paper 220 is separated into strips of photographs 322, 324, and 326 using scissors 310. While the printer paper 220 is cut using scissors 310, it is contemplated that the customer (not shown) could manually tear the inked printer paper 220 along the perforation lines to create strips of photographs 322, 324, and 326.

Figure 4:
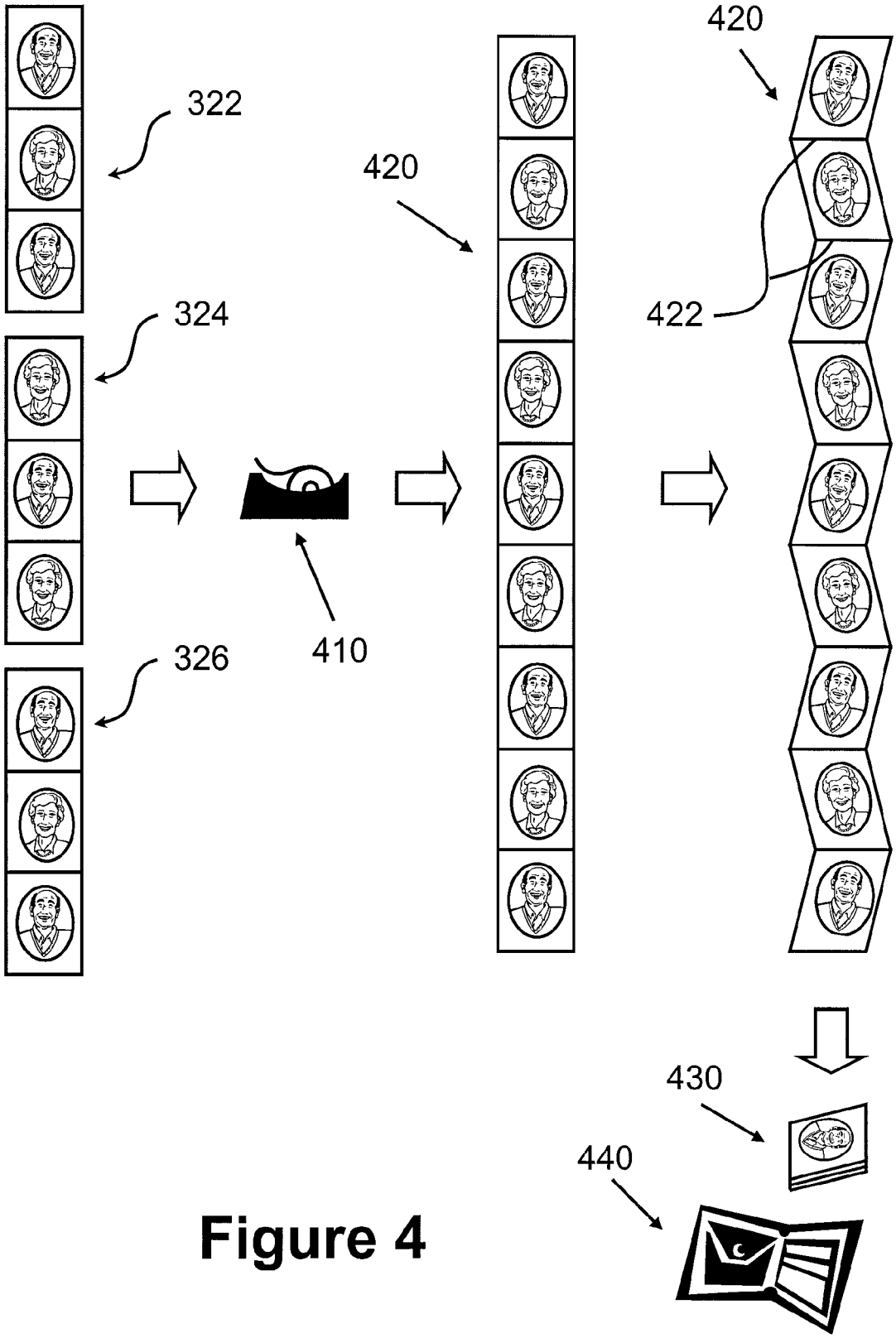
FIG. 4 is a diagrammatic flow-chart illustrating how the sheets of photographs are bonded end-to-end to form a foldable brag strip that fits within a wallet.

In FIG. 4, the strips of photographs 322, 324, and 326 are bonded to one another to create a folded brag strip 430 that can easily fit in wallet 440. The strips of photographs 322, 324, and 326 are arranged in a line end-to-end before tape 410 is used to bond the strips of photographs together into one brag strip 420. The tape is preferably transparent or translucent to prevent the tape from obscuring part of the photograph. Preferably, the tape is applied to the other side (not shown) of brag strip 420 so that the tape is not visible from a front of brag strip 420.

Once the customer creates a brag strip of photographs of a desired length, the customer could then fold the brag strip in an accordion style along scoring lines 422. As used herein, folding a strip of photographs in an "accordion style" means that the paper is first folded in one direction along one score line is then folded in the opposite direction along the next score line. This allows the brag strip to be folded without the edges of the brag strip bunching up and distorting or tearing the photographic image. The folded brag strip 430 has the dimensions of a single rectangle on the grid of printer paper 100, and only a small thickness. This allows the folded brag strip to be easily transportable, for example by being placed within wallet 440.

Figure 5:
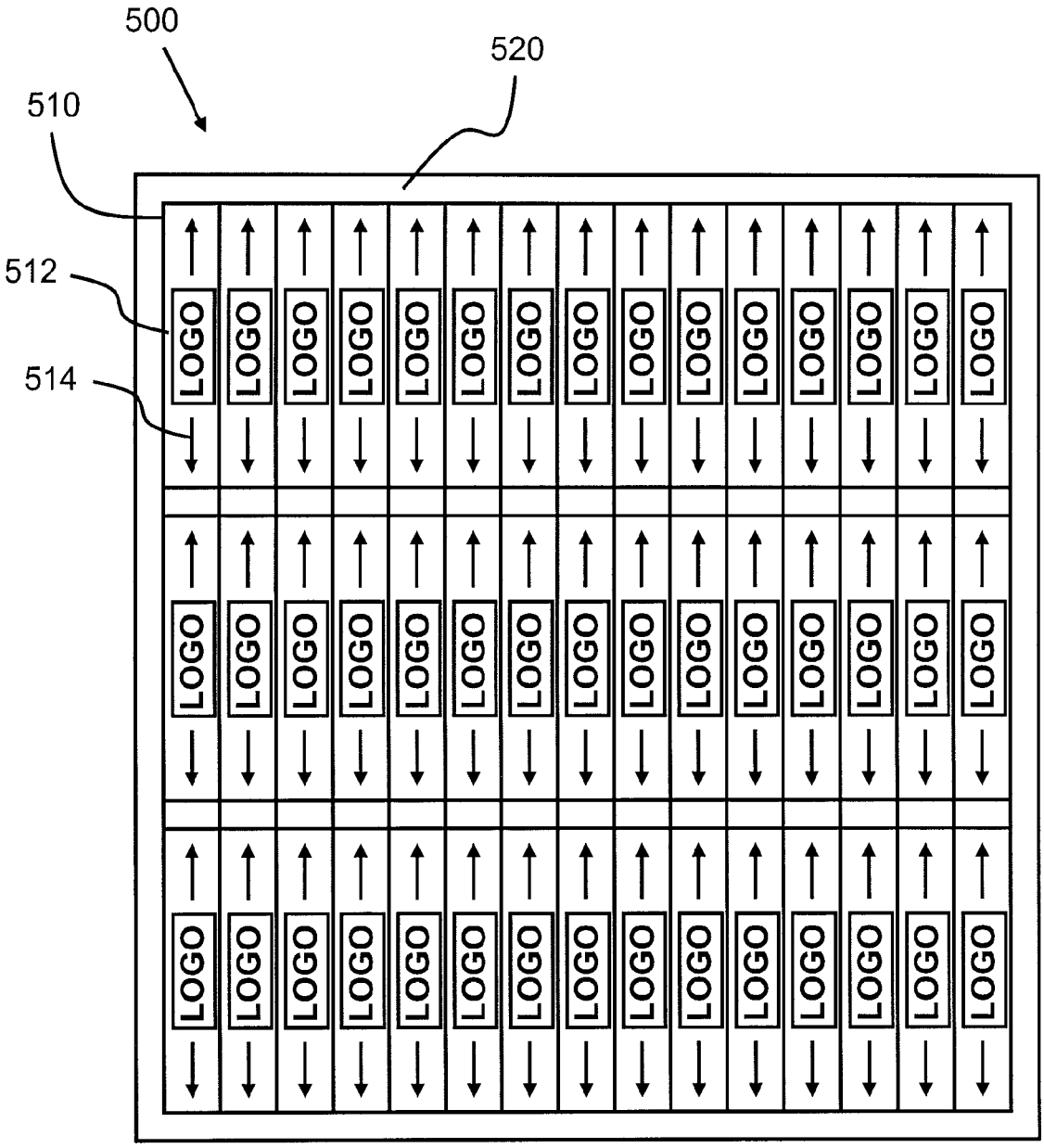
FIG. 5 is a front perspective view of a sheet of tape strips that provide adhesives that bond the sheets of photographs in FIG. 4.

In FIG. 5, a sheet of tape 500 has multiple strips of tape 510 that are attached to a paper backing 520. Preferably, each strip of tape 510 is 3⅛"×⅜", within a tolerance of ⅛ of an inch, so as to fit on a strip of photographs without going beyond a width of the strip of photographs. Each strip of tape has a guide-line 514 to help a customer place the strip of tape along an edge of a strip of photographs. Preferably, the strip of tape is also substantially transparent to facilitate placement of the guide-line along an edge of the strip of photographs. An optional logo 512 could be placed on each strip of tape to help advertise the provider of the brag strip. It is contemplated that words, trademarks, or slogans could also be printed on the strip of tape in place of a logo.

Figure 6:
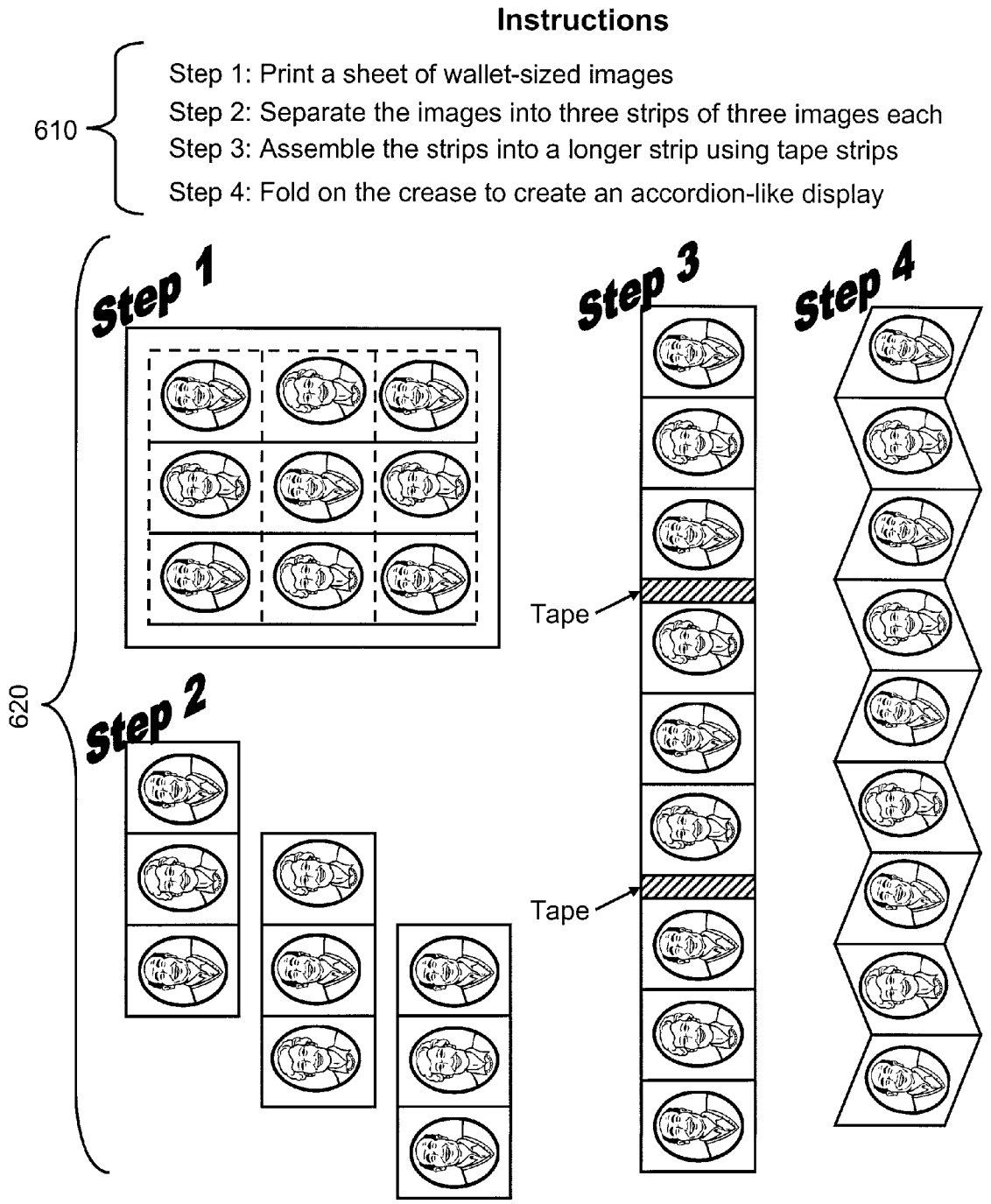
FIG. 6 is an exemplary sheet of instructions for using the printer paper of FIG. 1.

FIG. 6 is an example of a preferred set of instructions that is provided to a customer with sheets of printer paper 100 and sheets of tape 500. The instructions have written text 610 and corresponding diagrams 620 to show a customer how to create a brag strip using the printer paper 100 and sheet of tape 500.

Thus, specific embodiments and applications of creating strips of disposable, wallet-sized portable photo albums have been disclosed. It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

The invention claimed is:

1. A system of producing a pocket-sized, disposable photo album, comprising:

a sheet of printer paper with at least two perforated parallel lines and at least two scored parallel lines that are substantially perpendicular to the parallel lines, wherein the perforated parallel lines comprise a series of holes in the paper, and the scored parallel lines comprise a scratched surface along the paper;

a first set of instructions for printing photographs between the perforated and scored lines on the sheet of printer paper;

a second set instructions for separating the perforated paper along the perforated lines to form at least first and second strips of photographs;

an adhesive that adheres an end of the first strip with an end of the second strip; and a third set of instructions for coupling the end of the first strip with an end of the second strip and folding the strips accordion-style along the scored lines.

2. The system of claim 1, wherein the perforated parallel lines are located on opposite sides of the printer paper.

3. The system of claim 1, wherein the first set of instructions comprises computer software.

4. The system of claim 1, further comprising a third set of instructions for folding the bonded strips of photographs along at least one of the scored lines.

5. The system of claim 1, wherein the adhesive is provided on the sheet of printer paper.

6. The system of claim 5, wherein the adhesive is disposed on an end of a strip of photographs.

7. The system of claim 1, wherein the adhesive is disposed on a strip of tape.

* * * * *

UNITED STATES PATENT AND TRADEMARK OFFICE

CERTIFICATE OF CORRECTION

PATENT NO. : 9,073,377 B2
APPLICATION NO. : 12/247307
DATED : July 7, 2015
INVENTOR(S) : Michael Friedl It is certified that error appears in the above-identified patent and that said Letters Patent is hereby corrected as shown below:

Title page

Please correct the inventors name from:

(12) Freidl

(76) Inventor: Michael Freidl to

(12) Friedl

(76) Inventor: Michael Friedl

Signed and Sealed this
First Day of December, 2015

Michelle K. Lee

Michelle K. Lee
*Director of the United States Patent and Trademark Office*